US012366121B2

(12) United States Patent
Taylor

(10) Patent No.: US 12,366,121 B2
(45) Date of Patent: Jul. 22, 2025

(54) TOP CONNECTION FOR ELECTRICALLY IGNITED POWER CHARGE

(71) Applicant: Hunting Titan, Inc., Pampa, TX (US)

(72) Inventor: Zachary James Taylor, Waxahachie, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 18/562,759

(22) PCT Filed: Jun. 2, 2022

(86) PCT No.: PCT/US2022/072713
§ 371 (c)(1),
(2) Date: Nov. 20, 2023

(87) PCT Pub. No.: WO2022/256817
PCT Pub. Date: Dec. 8, 2022

(65) Prior Publication Data

US 2024/0229564 A1 Jul. 11, 2024

Related U.S. Application Data

(60) Provisional application No. 63/196,019, filed on Jun. 2, 2021.

(51) Int. Cl.

| | |
|---|---|
| ***F42D 1/045*** | (2006.01) |
| ***E21B 17/02*** | (2006.01) |
| *E21B 43/1185* | (2006.01) |

(52) U.S. Cl.
CPC ..... *E21B 17/023* (2013.01); *E21B 17/0285* (2020.05); *F42D 1/045* (2013.01); *E21B 43/1185* (2013.01)

(58) Field of Classification Search
CPC ..... F42D 1/045; E21B 17/0285
See application file for complete search history.

(56) References Cited

U.S. PATENT DOCUMENTS

| | | | |
|---|---|---|---|
| 4,852,494 | A | 8/1989 | Williams |
| 4,913,231 | A | 4/1990 | Muller et al. |
| 5,911,277 | A | 6/1999 | Hromas et al. |

(Continued)

OTHER PUBLICATIONS

Extended European Search Report dated Apr. 1, 2025, issued during the prosecution of EP 22817031.2.

*Primary Examiner* — J. Woodrow Eldred
(74) *Attorney, Agent, or Firm* — Troutman Pepper Locke LLP; Joshua L. Jones

(57) ABSTRACT

A top connection and sub that provides a reliable electrical connection between a perforating gun and a power charge using a housing with a distal protrusion having a hollow opening adapted to receive a power charge and at least one locking mechanism for locking to the end of a power charge, wherein the first end is adapted to be coupled to a perforating gun and the second end is adapted to couple to a setting tool, and the distal protrusion is adapted to twist and lock to a power charge, a contact assembly comprising a contact housing with a contact rod disposed therein and insulated from the contact housing, a retainer nut containing a feed thru contact pin, slideably disposed within the retainer nut and electrically coupled to the contact rod with a spring, for a more reliable electrically ignited power charges in perforating gun strings.

20 Claims, 5 Drawing Sheets

(56) References Cited

U.S. PATENT DOCUMENTS

| | | | |
|---|---|---|---|
| 9,464,495 | B2 | 10/2016 | Picciotti et al. |
| 10,408,025 | B2 | 9/2019 | Harrington et al. |
| 2012/0247769 | A1 | 10/2012 | Schacherer et al. |
| 2013/0153205 | A1 | 6/2013 | Borgfeld et al. |
| 2016/0333675 | A1 | 11/2016 | Wells et al. |
| 2019/0162057 | A1 | 5/2019 | Montoya Ashton et al. |
| 2020/0362654 | A1 | 11/2020 | Eitschberger et al. |
| 2024/0076943 | A1* | 3/2024 | Sampson ..... E21B 17/0285 |

* cited by examiner

TOP CONNECTION FOR ELECTRICALLY IGNITED POWER CHARGE

RELATED APPLICATIONS

This application is a U.S. national stage application of PCT/US22/72713, filed Jun. 2, 2022, which claims the benefit of U.S. Provisional Application No. 63/196,019, filed Jun. 2, 2021.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by a detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

Modular or "plug and play" perforating gun systems have become increasingly popular in recent years due to the case of assembly, efficiencies gained, and reduced human error. Most of the existing plug and play systems either (1) utilize a wired in switch and/or detonator, or (2) require an initiating "cartridge" that houses the detonator, switch, electrical contacts and possibly a pressure bulkhead. The wired in switch/detonator option is less desirable because the gun assembler must make wire connections which is prone to human error. The initiating cartridge option is less desirable because the cartridge can be a large explosive device—in comparison to a standard detonator—thus takes up additional magazine space at the user facility.

SUMMARY OF EXAMPLE EMBODIMENTS

An example embodiment may include an electrical top connector assembly including a housing with a first end and a second end with a distal protrusion, the distal protrusion having a hollow opening adapted to receive a power charge and at least one locking mechanism for locking to the end of a power charge, wherein the first end is adapted to be coupled to a perforating gun and the second end is adapted to couple to a setting tool, and the distal protrusion is adapted to twist and lock to a power charge, a contact assembly comprising a contact housing with a contact rod disposed therein and insulated from the contact housing, a retainer nut containing a feed thru contact pin, slideably disposed within the retainer nut and electrically coupled to the contact rod with a spring.

A variation of the example embodiment may include the first end being a box end adapted to couple to the pin end of a perforating gun. The second end may be a pin end adapted to couple to the box end of a setting tool. It may include a first insulator washer supporting the contact rod within the contact housing. It may include a second insulator washer supporting the contact rod within the contact housing. It may include a second insulator washer supporting the contact rod within the contact housing. The contact housing may be grounded. The contact rod may provide electrical communication for a signal. The locking mechanism may be a j-lock cutout.

An example embodiment may include a perforating gun system including a first perforating gun having a first end, an electrical top connector assembly further comprising, a housing with a first end and coupled to the first end of the first perforating gun, a second end with a distal protrusion, the distal protrusion having a hollow opening adapted to receive a power charge and at least one locking mechanism for locking to the end of a power charge, wherein the first end is adapted to be coupled to a perforating gun and the second end is adapted to couple to a setting tool, and the distal protrusion is adapted to twist and lock to a power charge, a contact assembly comprising a contact housing with a contact rod disposed therein and insulated from the contact housing, a retainer nut containing a feed thru contact pin, slideably disposed within the retainer nut and electrically coupled to the contact rod with a spring, a setting tool having a first end coupled to the second end of the electrical top connector assembly, a power charge having a first end, disposed within the setting tool, and coupled to the distal protrusion of the electrical top connector assembly.

A variation of the example embodiment may include the first end being a box end adapted to couple to a pin end of the perforating gun. The second end may be a pin end adapted to couple to the box end of the setting tool. It may include a first insulator washer supporting the contact rod within the contact housing. It may include a second insulator washer supporting the contact rod within the contact housing. It may include an insulator between the contact rod and the contact housing. The contact housing may be grounded. The contact rod may provide electrical communication for a signal between the setting tool and the first perforating gun. At least one locking mechanism may be a j-lock shaped cutout. At least one locking mechanism may be a cutout adapted to engage a power charge.

BRIEF DESCRIPTION OF THE DRAWINGS

For a thorough understanding of the example embodiments, reference is made to the following detailed description of the preferred embodiments, taken in conjunction with the accompanying drawings in which reference numbers designate like or similar elements throughout the several figures of the drawing. Briefly.

DETAILED DESCRIPTION OF THE EXAMPLE EMBODIMENTS

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems, and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Initiators may be used to initiate a perforating gun, a cutter, a setting tool, or other downhole energetic device. For example, a cutter is used to cut tubulars with focused energy. A setting tool uses a pyrotechnic to develop gases to perform work in downhole tools. Any downhole device that uses an initiator may be adapted to use the modular initiator assembly disclosed herein.

Figure 1:
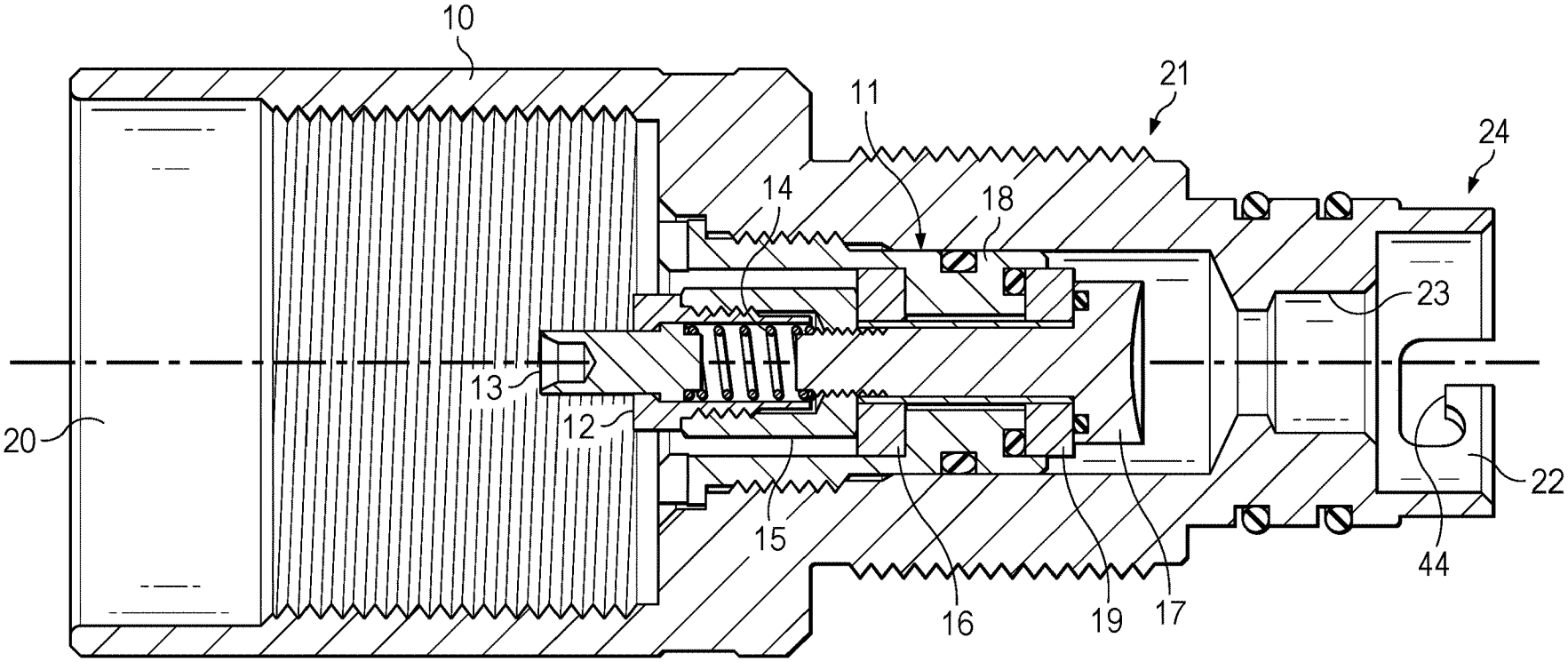
FIG. 1 shows a cross section of an electrical top connector assembly.
Figure 2:
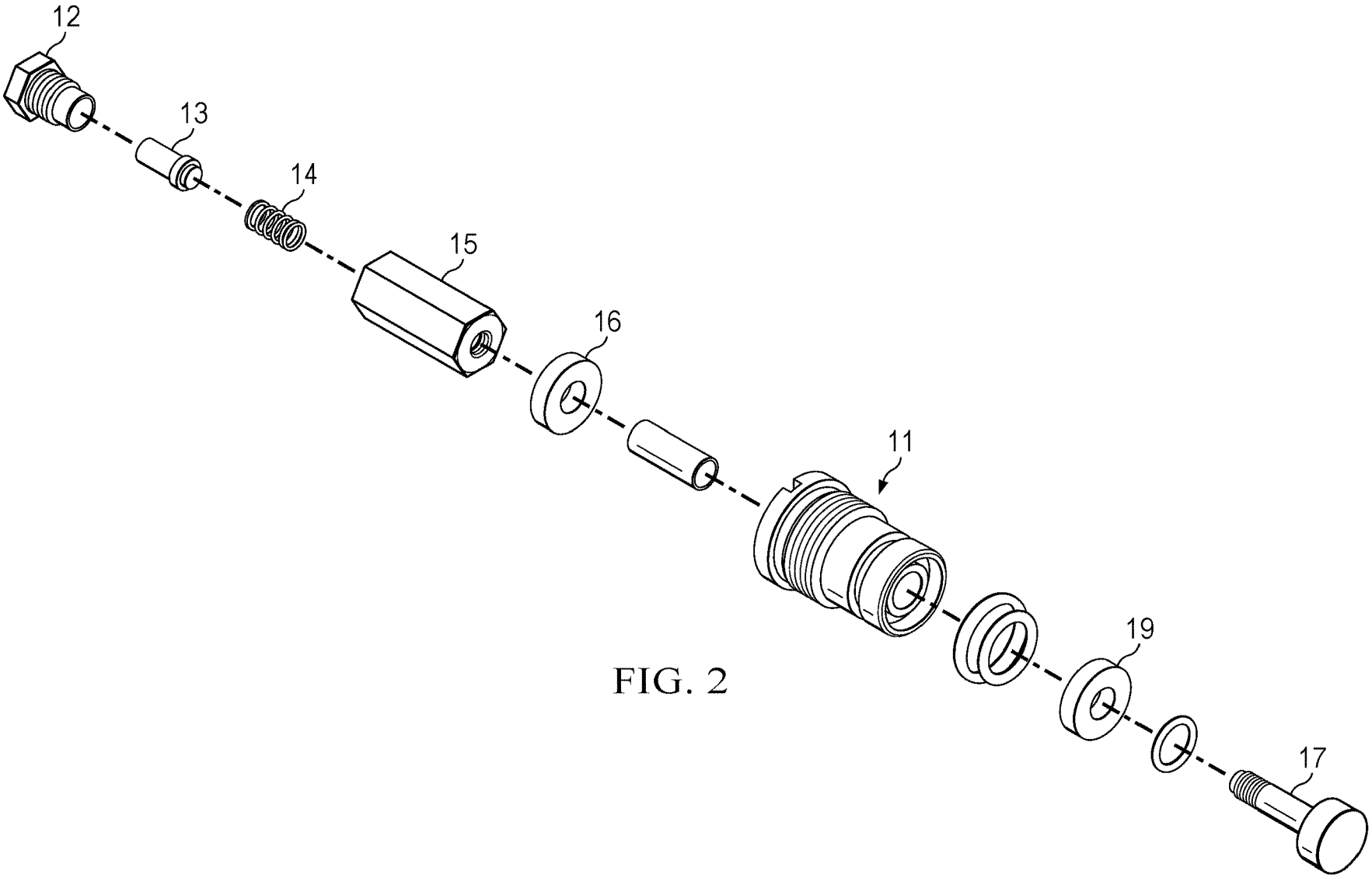
FIG. 2 shows an assembly view of an electrical top connector assembly.

An example embodiment is shown in FIG. 1 includes a sub 10 containing a contact assembly 11 disposed within a hollow bore. The contact assembly 11 includes a contact housing 18 containing a feed thru contact pin 13 disposed within a contact retainer 12. The contact retainer 12 is disposed within a retainer nut 15. The retainer nut 15 is insulated from the contact housing 18 by the insulator washer 16. A contact rod 17 is disposed within the contact housing 18 and is electrically isolated from the contact housing 18 via insulator washers 16 and 19. The contact rod 17 is electrically coupled to the feed thru contact pin 13 via spring 14. The sub 10 includes a box end 20 and a pin end 21. The distal end of the pin end 21 includes a connector end 24 that has one or more locking mechanism 22. In this example, the locking mechanism disclosed is a j-lock cutout with a tab 44 for securing a pin. An example embodiment of the contact assembly 11 is shown in FIG. 2 in an exploded assembly view.

Figure 3:
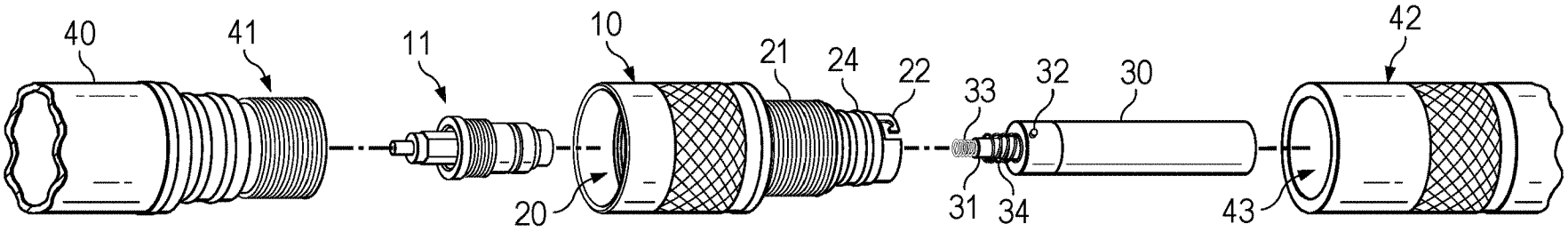
FIG. 3 shows an assembly view of an electrical top connector assembly housing in a sub connecting a perforating gun to a power charge.

An example embodiment of the assembly is shown in FIG. 3. A perforating gun 40 with a pin end 41 is coupled to the box end 20 of the sub 10. A contact assembly 11 is disposed within the sub 10. Sub 10 includes a pin end 21 having a distal connector end 24 with a locking mechanism 22, in this example the locking mechanism is a j-lock coupling. The locking mechanism 22 is adapted to engage with the pins 32 located on the power charge 30. The power charge 30 includes a connector end 31 having a ground wire spring 34 and a thru wire spring 33. The connector end 31 electrically couples to the contact assembly 11. Power charge 30 is disposed in the setting tool 42. The setting tool 42 has a box end 43 that engages the pin end 21. The contact assembly 11 provides for electrical communication between the perforating gun 40 and the setting tool 42.

Figure 4:
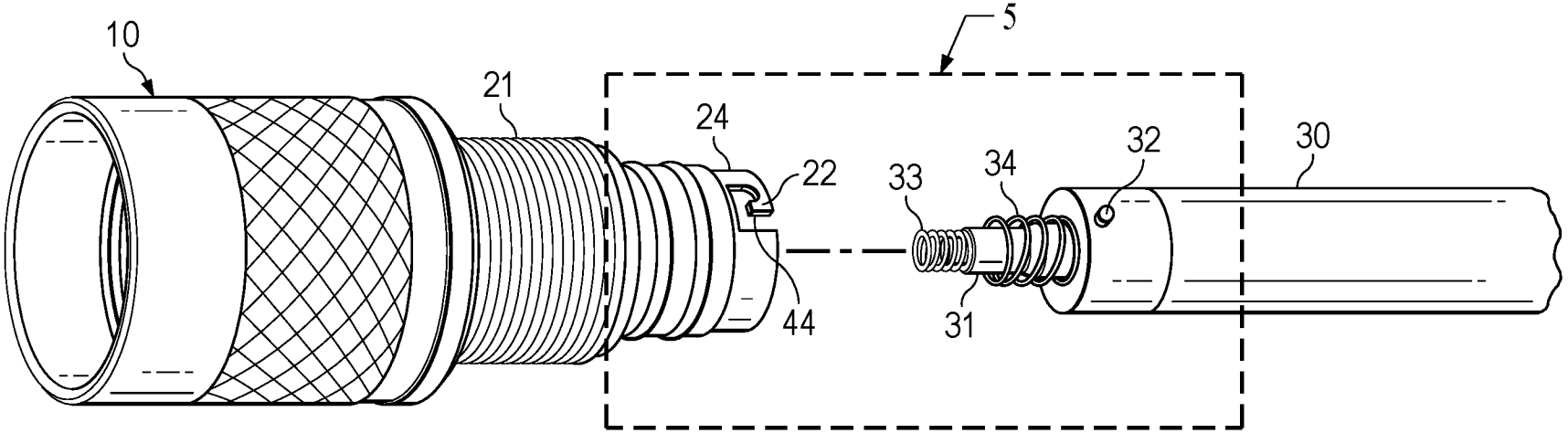
FIG. 4 shows an assembly view of an electrical top connector assembly housing in a sub connecting to a power charge.
Figure 5:
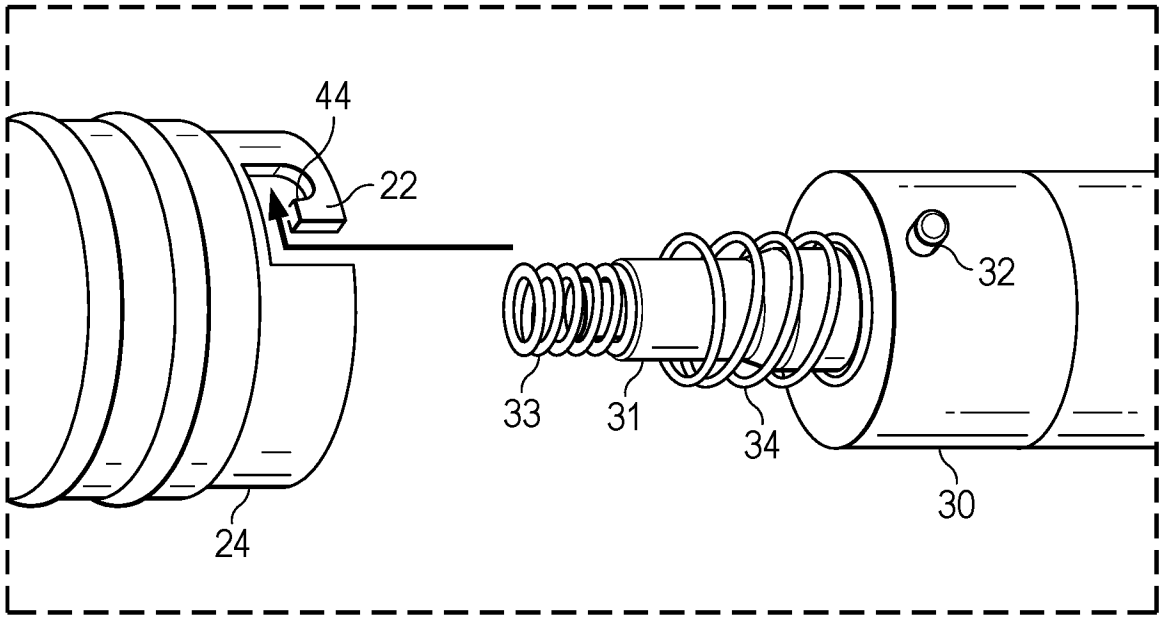
FIG. 5 shows an assembly view of an electrical top connector assembly housing in a sub connecting to a power charge.

An example embodiment of the locking mechanism detail is shown in FIGS. 4 and 5. The sub 10 has a pin end 21 and a distal connector end 24 with a locking mechanism 22. The pins 32 engage the locking mechanism 22 first in an axial motion to initially engage the pins 32 and then the pins are rotated clockwise to further engage the pins past the locking tabs 44. This secures the power charge 30 to the sub 10. It furthermore positions the thru wire spring 33 and the ground wire spring 34 on the connector end 31 to engage with the contact assembly 11 located within the sub 10.

Although the example embodiments have been described in terms of embodiments which are set forth in detail, it should be understood that this is by illustration only and that the example embodiments are not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the example embodiments are contemplated which may be made without departing from the spirit of the claimed example embodiments.

What is claimed is:

1. An electrical top connector assembly comprising:

a housing with a first end and a second end with a distal protrusion, the distal protrusion having a hollow opening adapted to receive a power charge and at least one locking mechanism for locking to the end of a power charge, wherein the first end is adapted to be coupled to a perforating gun and the second end is adapted to couple to a setting tool, and the distal protrusion is adapted to twist and lock to a power charge;

a contact assembly comprising a contact housing with a contact rod disposed therein and insulated from the contact housing;

a retainer nut containing a feed thru contact pin, slideably disposed within the retainer nut and electrically coupled to the contact rod with a spring.

2. The electrical top connector assembly of claim 1 wherein the first end is a box end adapted to couple to the pin end of a perforating gun.

3. The electrical top connector assembly of claim 1, wherein the second end is a pin end adapted to couple to the box end of a setting tool.

4. The electrical top connector assembly of claim 1, further comprising a first insulator washer supporting the contact rod within the contact housing.

5. The electrical top connector assembly of claim 4, further comprising a second insulator washer supporting the contact rod within the contact housing.

6. The electrical top connector assembly of claim 1, further comprising an insulator between the contact rod and the contact housing.

7. The electrical top connector assembly of claim 1 wherein the contact housing is grounded.

8. The electrical top connector assembly of claim 1 wherein the contact rod provides electrical communication for a signal.

9. The electrical top connector assembly of claim 1 wherein the at least one locking mechanism is a j-lock shaped cutout.

10. The electrical top connector assembly of claim 1 wherein the at least one locking mechanism is a cutout adapted to engage a power charge.

11. A perforating gun system comprising:

a first perforating gun having a first end;

an electrical top connector assembly further comprising:

a housing with a first end and coupled to the first end of the first perforating gun, a second end with a distal protrusion, the distal protrusion having a hollow opening adapted to receive a power charge and at least one locking mechanism for locking to the end of a power charge, wherein the first end is adapted to be coupled to a perforating gun and the second end is adapted to couple to a setting tool, and the distal protrusion is adapted to twist and lock to a power charge;

a contact assembly comprising a contact housing with a contact rod disposed therein and insulated from the contact housing; and a retainer nut containing a feed thru contact pin, slideably disposed within the retainer nut and electrically coupled to the contact rod with a spring; and a setting tool having a first end coupled to the second end of the electrical top connector assembly;

a power charge having a first end, disposed within the setting tool, and coupled to the distal protrusion of the electrical top connector assembly.

12. The electrical top connector assembly of claim 11 wherein the first end is a box end adapted to couple to a pin end of the perforating gun.

13. The electrical top connector assembly of claim 11, wherein the second end is a pin end adapted to couple to the box end of the setting tool.

14. The electrical top connector assembly of claim 11, further comprising a first insulator washer supporting the contact rod within the contact housing.

15. The electrical top connector assembly of claim 14, further comprising a second insulator washer supporting the contact rod within the contact housing.

16. The electrical top connector assembly of claim 11, further comprising an insulator between the contact rod and the contact housing.

17. The electrical top connector assembly of claim 11 wherein the contact housing is grounded.

18. The electrical top connector assembly of claim 11 wherein the contact rod provides electrical communication for a signal between the setting tool and the first perforating gun.

19. The electrical top connector assembly of claim 11 wherein the at least one locking mechanism is a j-lock shaped cutout.

20. The electrical top connector assembly of claim 11 wherein the at least one locking mechanism is a cutout adapted to engage a power charge.

* * * * *